US011608717B2

(12) United States Patent
Lehrling et al.

(10) Patent No.: US 11,608,717 B2
(45) Date of Patent: Mar. 21, 2023

(54) TOOL DEPLOYMENT AND CLEANOUT SYSTEM

(71) Applicant: Halliburton Energy Services, Inc., Houston, TX (US)

(72) Inventors: Gunnar Lehrling, Mount Pearl, CA (US); Peter Reid Maher, Lafayette, LA (US)

(73) Assignee: Halliburton Energy Services, Inc., Houston, TX (US)

( * ) Notice: Subject to any disclaimer, the term of this patent is extended or adjusted under 35 U.S.C. 154(b) by 7 days.

(21) Appl. No.: 17/366,183

(22) Filed: Jul. 2, 2021

(65) Prior Publication Data

US 2022/0325611 A1 Oct. 13, 2022

Related U.S. Application Data

(60) Provisional application No. 63/173,179, filed on Apr. 9, 2021.

(51) Int. Cl.

| | |
|---|---|
| ***E21B 37/10*** | (2006.01) |
| ***E21B 31/06*** | (2006.01) |
| ***E21B 37/08*** | (2006.01) |
| ***E21B 27/00*** | (2006.01) |
| ***E21B 43/02*** | (2006.01) |

(52) U.S. Cl.

CPC ..... *E21B 37/10* (2013.01); *E21B 27/005* (2013.01); *E21B 31/06* (2013.01); *E21B 37/08* (2013.01); *E21B 43/02* (2013.01)

(58) Field of Classification Search

CPC ..... E21B 37/10; E21B 31/06; E21B 43/02; E21B 27/005; E21B 21/002

See application file for complete search history.

(56) References Cited

U.S. PATENT DOCUMENTS 3,797,572 A * 3/1974 Mignotte ..... E21B 23/06 166/134
7,040,395 B2 * 5/2006 Booth ..... E21B 37/02 166/173

(Continued)

FOREIGN PATENT DOCUMENTS

WO 02-081858 10/2002

OTHER PUBLICATIONS

ARdVAC™ Venturi XTRactR™ Tool, Odfjell Well Services, Accessed Jun. 30, 2021.

(Continued)

*Primary Examiner* — Nicole Coy
*Assistant Examiner* — Nicholas D Wlodarski
(74) *Attorney, Agent, or Firm* — Scott Richardson; C. Tumey Law Group PLLC

(57) ABSTRACT

A variety of systems and methods are disclosed for cleaning a wellbore ahead of a well tool. The well tool is deployed on a tubular conveyance to a depth into a well. An interior surface of the well is wiped ahead of the well tool to dislodge debris from the interior surface of the well as the tubular conveyance advances downhole. The debris is filtered ahead of the well tool as the tubular conveyance advances downhole to keep the filtered debris away from the well tool. The well tool may then be used to perform a tool function when the tubular conveyance has reached the depth, without being affected by the filtered debris.

20 Claims, 6 Drawing Sheets

(56) References Cited

U.S. PATENT DOCUMENTS

| | | | | |
|---|---|---|---|---|
| 8,336,616 | B1 | 12/2012 | McClinton | |
| 8,651,181 | B2 * | 2/2014 | Knobloch | E21B 37/02 166/227 |
| 10,344,556 | B2 * | 7/2019 | Meeks | E21B 33/128 |
| 2005/0121233 | A1 | 6/2005 | Frith | |
| 2008/0029263 | A1 | 2/2008 | Palmer et al. | |
| 2013/0140028 | A1 | 6/2013 | Cooper | |
| 2016/0305219 | A1 | 10/2016 | Holloway et al. | |
| 2016/0032693 | A1 | 11/2016 | Lehrling | |
| 2019/0226301 | A1 | 7/2019 | Rahman | |

OTHER PUBLICATIONS

Heavy duty well patroller, MI SWACO, Schlumberger, Accessed Jun. 30, 2021.

Wellbore Cleaning Services, Enabling effective completions through mechanical and chemical wellbore cleaning, Weatherford, Accessed Jun. 30, 2021.

XP wellbore cleanup system, Baker Hughes, Accessed Jun. 30, 2021.

International Search Report and Written Opinion for Application No. PCT/US2021/041046, dated Dec. 13, 2021.

* cited by examiner

TOOL DEPLOYMENT AND CLEANOUT SYSTEM

CROSS-REFERENCE TO RELATED APPLICATIONS

The present application is a non-provisional application claiming priority to provisional application 63/173,179, filed on Apr. 9, 2021, the entire disclosure of which is incorporated herein by reference.

BACKGROUND

In the drilling and completion of oil and gas wells, a number of situations arise in which solids are present in wellbore fluids such as drilling or completions fluids. For example, when drilling a well, wellbore cuttings are generated that enter the drilling fluid (mud) being circulated. Although cuttings may be removed at the surface of the wellsite before the mud is recirculated downhole, some may remain in the well. Some solids may end up in the completion fluid from a layer of mud on the interior of the casing string or from surface tanks. Additional debris may be generated in working in the well, such as cement particles generated during cementing, shaped charge fragments generated during perforating, pieces of downhole equipment which have been drilled and/or milled, junk lost in the hole, and so forth.

In running a well tool downhole, failed runs may be at least partially attributable to debris in the wellbore. This can be manifested, for example, by well tools getting stuck while running in hole, circulation ports becoming plugged, J-Slots being rendered inoperable due to debris, and sealing components unable to work as designed. A cleanout run may be performed to remove solids from a completion fluid, prior to deploying a well tool downhole. However, these cleanout runs are sometimes skipped, which can increase the likelihood of failure. Also, attempting to run a cleanout tool such as a scraper below drillable or retrievable tools may actually dislodge debris that will end up reaching the drillable or retrievable tool, potentially defeating the purpose of running cleanout tools.

BRIEF DESCRIPTION OF THE DRAWINGS

These drawings illustrate certain aspects of some of the embodiments of the present disclosure and should not be used to limit or define the method.

DETAILED DESCRIPTION

Figure 1:
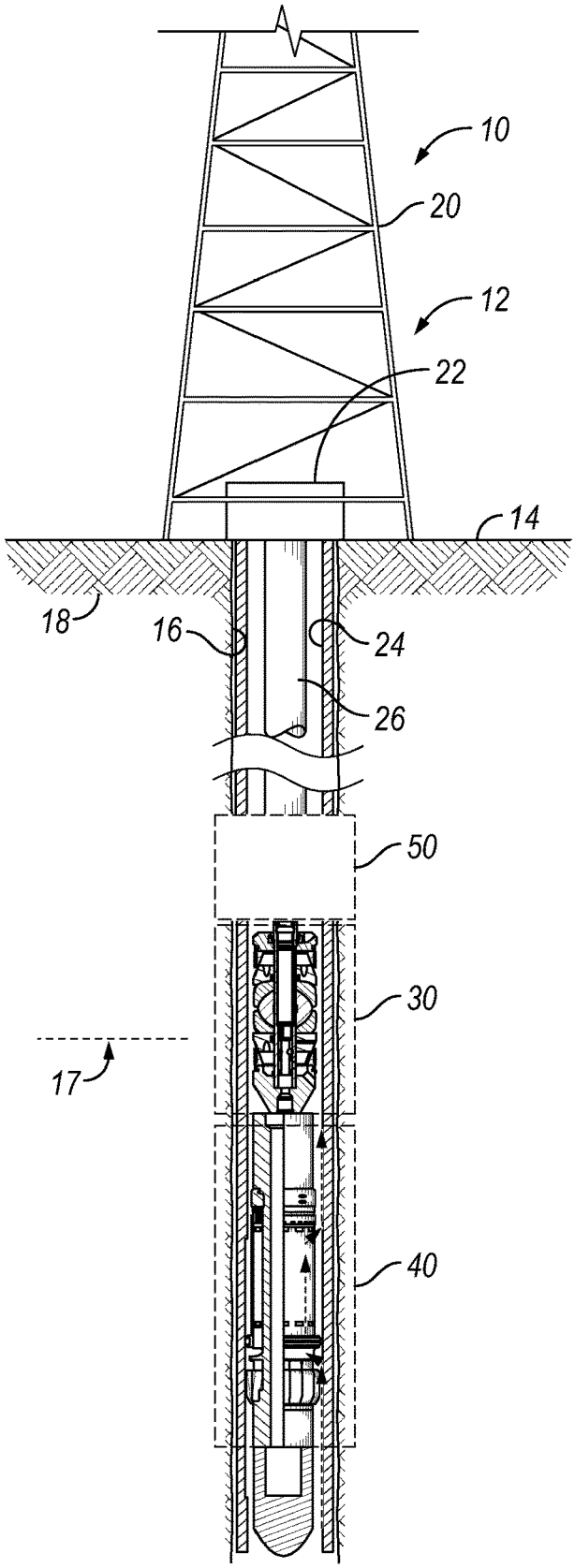
FIG. 1 is an elevation view of a well site in which aspects of this disclosure may be implemented.

This disclosure is generally directed to a cleanout tool, system, and method for filtering debris ahead of a well tool when running into a well. The well tool can be any tool that is lowered into the well on a tubular conveyance, for performing a tool function at a desired depth. The tubular conveyance is typically a tubing string, as in the examples below, but may alternatively comprise coiled tubing or other suitable conveyance that preferably allows for flow. The well tool can be, for example, a settable tool to be set downhole and later retrieved and/or a drillable tool that may be set and later drilled out. The well tool may alternatively be a service tool tripped into the well on a work string, without being set, to perform a service and tripped out on the same work string after the service is performed.

Another tool, which may be referred to generally as the cleanout tool, is positioned on the tubing string below the well tool, to filter out debris ahead of the well tool. The cleanout tool may include a filter for filtering out loose debris from a well fluid while allowing the well fluid to flow through it. The cleanout tool may also include a wiper radially extending into engagement with the wellbore to help urge debris downward and dislodge loose debris from the wellbore. One or more scrapers may also be positioned further down the tubing string below the wiper, to more forcibly dislodge debris stuck to the wellbore so it can also be filtered ahead of the well tool. Additional tubing string components may include a magnet for capturing a portion of ferromagnetic debris, stabilizers or centralizers for spacing the tubing string within the wellbore, and a bullnose for guiding the tubing string.

By filtering, and optionally wiping and/or scraping, ahead of the well tool, the well can be cleaned and debris can be filtered out that might otherwise lead to a failure of the well tool. The types of failures avoided may include, for example, contamination of the well tool or its operation (e.g., moving parts), or corrupting a tool-setting area of the wellbore where the well tool is to be set. These teachings may be effective even in the event that a cleanout run is skipped after drilling the wellbore and prior to running the well tool with the cleanout tool attached. Desirably, the tools, system, and methods do not require a separate trip for cleaning the wellbore prior to a separate trip where the well tool is to be deployed. Rather, the cleanout for the well tool may be performed ahead of the well tool in a single trip.

In one example configuration, a cleanout tool includes a diverter that is shiftable between a bypass position corresponding to a bypass mode and a filtering position corresponding to a filter mode. The diverter may be shifted from bypass position to filtering position in response to movement of the well tool relative to the wellbore as it is tripped downhole and/or circulating well fluid downhole through the tubing string and up an annulus between the tubing string and the wellbore. The diverter may be shifted back to bypass mode in response to pulling up on the tubing string, e.g., when tripping out of hole, and/or in response to circulating in the opposite direction, i.e., reverse circulating. The diverter may include a wiper to wipe the inner diameter (ID) of the casing or wellbore, and to frictionally engage the casing or wellbore to help shift the diverter in response to movement of the tubing string. The filter sleeve may at least temporarily collect the debris due to the downhole movement of the tool, even if debris may fall to the bottom of the well when string movement has stopped and be recollected once the tool continues to be run in hole.

FIG. 1 is an elevation view of a well site 10 in which aspects of this disclosure may be implemented. While FIG. 1 generally depicts the well site 10 as being for land-based hydrocarbon production, the principles described herein are equally applicable to offshore or subsea production operations that employ floating or sea-based platforms and rigs, or even other fluid-conveying pipes in the industry that may require cleanout and filtering ahead of a tool, such as oil and gas pipelines, without departing from the scope of the disclosure. The well site 10 may include an oil and gas rig 12 arranged at the earth's surface 14 and a wellbore 16 extending therefrom and penetrating a subterranean earth formation 18. The wellbore 16 may follow any given wellbore path. For ease of illustration, FIG. 1 just shows a vertical section extending from the surface 14, although direction drilling techniques may be employed to form the wellbore 16 with any given wellbore path including vertical and non-vertical (deviated) sections. Portions of the wellbore 16 may be reinforced with tubular metal casing 24 cemented within the wellbore 16. The wellbore 16 may be in a completions phase, or already completed and in a production phase. In either case, various well tools may, from time to time, need to be tripped downhole into the wellbore 16.

A large support structure, such as a derrick 20, is erected at the well site 10 on a support foundation or platform, such as a rig floor 22. In a subsea context, the earth's surface 14 may alternatively represent the floor of a seabed, and the rig floor 22 may be on the offshore platform or floating rig over the water above the seabed. The derrick 20 may be used to support equipment in constructing, completing, producing, or servicing the wellbore 16. The derrick 20 may be used, for example, to support a tubing string 26 as it is lowered into and/or retrieved from the wellbore 16. Such a tubing string 26 may serve as a conveyance to lower and retrieve tools on, such as packers, bridge plugs, subsurface safety valves, and service tools. The tubing string 26 may also convey fluids from or to the surface 14, and/or support the communication of signals and power during wellbore operations.

A well tool 30 is coupled to the tubing string 26, along with a cleanout tool 40 disposed below the well tool 30 on the same tubing string 26. The well tool 30 may be conveyed downhole on the tubing string 26 to any desired depth 17 where the well tool 30 will be used to perform a tool function. The well tool 30 can be any of a variety of tools that are deployable downhole on a tubing string, which will benefit from cleanout and/or filtering performed ahead of the well tool 30 by the cleanout tool 40. The tool function may be any function the well tool 30 is designed to perform downhole, for which debris in the well fluid can interfere with proper functioning. One example of a tool function includes packing or otherwise sealing a wellbore or other downhole sealing surface, where debris in the well fluid can affect the well tool's ability to seal with the wellbore or downhole sealing surface. A tool function may also be any function the well tool is designed to perform involving a moveable part, wherein debris in the fluid can interfere with or otherwise adversely affect movement of the moveable part. A tool function may also be any function the well tool is designed to perform downhole that uses transmission of an electromagnetic wave through the well fluid, such as for downhole imaging, sensing, or signal transmission, wherein debris in the well fluid can interfere with such transmission.

In some examples, the well tool 30 can be a type of tool that is set in place downhole in a particular trip, such as with a setting tool schematically indicated at 50, and optionally decoupled from the tubing string 26. In some cases, such a tool that is set in place and decoupled from the tubing string 26 can later retrieved by a tubing string on a subsequent, separate trip. Alternatively, a tool set in place and decoupled from the tubing string 26 can later be drilled out rather than retrieving the tool. In other cases, the well tool 30 may be a service tool tripped into the wellbore 16, wherein the tubing string 26, remains coupled to the well tool while performing the tool function, and the tool function is involved in performing a service, such as a stimulation treatment. In the context of such a service tool, the tubing string 26 may be referred to as a work string. Some service tools rely on a work string to remain coupled to the tool to serve as a conduit for a service fluid, such as a stimulation fluid, and tripped out on the same work string after a service is performed. Such a service tool may eventually be tripped out of the wellbore 16 on the same tubing string (the work string) that it was tripped into the wellbore 16 on.

The cleanout tool 40 is coupled to the tubing string 26 below the well tool 30, so that the cleanout tool 40 may perform cleanout and filtering ahead of the well tool 30 when tripped into the well. The cleanout tool 40 may be located on the tubing string 26 immediately ahead of the well tool 30, as depicted in FIG. 1, or may be axially spaced further ahead of the well tool 30. As the tubing string 26 is tripped downhole, the cleanout tool 40 may remain at a fixed position relative to the well tool 30. The cleanout tool 40 may be used to clean the wellbore 16 ahead of the well tool 30 by a combination of cleaning and filtering. More particularly, the cleanout tool 40 may wipe the inner surface of the wellbore 16 to dislodge debris. As further discussed below, the cleanout tool 40 may also be used to filter any debris in the fluid, including but not necessarily limited to any debris that was dislodged by the cleanout tool 40, to keep the debris away from the well tool 30 above the cleanout tool 40. In one example, the well tool 30 may be intended to be set in place in a particular part of the casing 24, and the cleanout tool 40 may clean the generally circular inner diameter (ID) of the casing 24 where slips may be deployed to anchor the well tool 30 and/or where a sealing element such as a packer element, bridge plug, or the like is going to seal against the ID of the casing 24.

Figure 2:
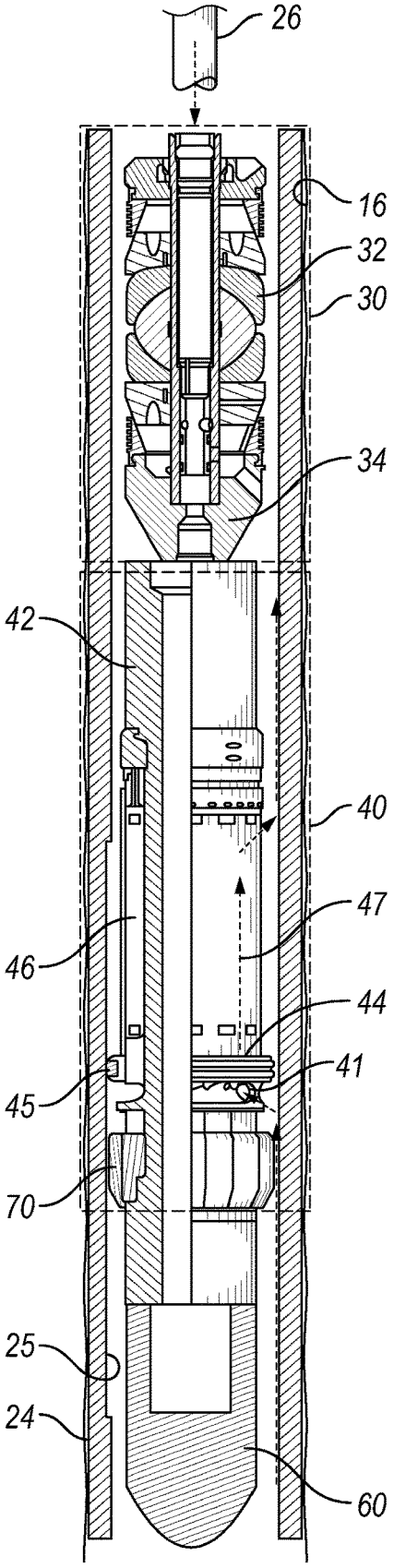
FIG. 2 is an enlarged view of example configurations of the well tool and cleanout tool of FIG. 1 in a filter mode.

FIG. 2 is an enlarged view of well tool 30 and cleanout tool 40 of FIG. 1, as disposed in the wellbore 16 in a filter mode, according to an example configuration. The setting tool is omitted in this view although it is understood a setting tool may be included with the tubing string 26 such as above the well tool 30 if the well tool 30 is to be set in place. For example, the well tool 30 may be a settable packer or a plug, which may be located and set using a setting tool (e.g. setting tool 50 of FIG. 1) to isolate the lower part of the wellbore. The well tool 30 is depicted by way of example in FIG. 2 as a cement retainer, such as an EZ Drill® SVB Squeeze Packer available from Halliburton Energy Services, Inc. This example may also include a packer 32, optionally with a drill gun adapter (DGA) or drill brush adapter (DBA) 34 for coupling to the cleanout tool 40.

The cleanout tool 40 includes a mandrel 42 that may be coupled at either or both ends to the tubing string and which supports components of the well tool 40. A valve element, referred to generally as a diverter and more specifically referred to as a diverter sleeve 44 in this example, is disposed on the mandrel 42. A wiper 45 is optionally disposed on the diverter sleeve 44 and contacts the inner surface of the wellbore. The wiper 45 may specifically be sized to wipe a portion of the wellbore, e.g., the ID 25 of the casing 24, where the well tool 30 is to be positioned to perform the intended tool function of the well tool 30. The wiper wipes the wellbore 16 by slidingly contacting the wellbore 16, at least along a portion of the wellbore where the well tool is to perform a tool function. Wiping at least helps push debris downward and minimizes debris migrating past the wiper 45. By slidingly contacting the wellbore with the wiper 45, the wiper may also help dislodge debris from the wellbore 16 ahead of the well tool 30. In that respect, the wiper 45 may have any suitable configuration or material for wiping a portion of the interior of the wellbore, including but not limited to an elastomeric element, a scraper element, or a brush element.

The diverter sleeve 44 may be shifted between a filtering position (FIG. 2) and a bypass position (FIG. 3) using relative movement between the tubing string 26 and the wellbore 16 while the wellbore 16 is frictionally contacted by the wiper 45. The diverter sleeve 44 is shifted to the filtering position as the tubing string 26 advances downhole, such as when the string is run into hole (RIH). The diverter sleeve 44 is shifted to the bypass position as the tubing string advances uphole, such as when pulling out of hole (POOH). Since the wiper 45 is coupled to the diverter sleeve 44, urging the tubing string 26 downward shifts the diverter sleeve 44 up relative to the mandrel 42 to the filtering position corresponding to a filter mode. In the filtering position/mode, the diverter sleeve 44 seals against the lower end of the filtering sleeve 46, so that well fluid travels into ports 41 on the diverter sleeve 44 and into the filtering sleeve 46 to filter out debris. The filtered fluid travels up out of apertures along the filtering sleeve 46 as indicated by the flow arrows 47, and any debris filtered out of the fluid by the filtering sleeve 46 is not allowed to pass upward of the filtering sleeve 46.

Although the filtering sleeve 46 may periodically release the filtered debris, such as when temporarily halting downhole movement of the tubing string 26, any debris released would remain downhole of the well tool 30. Thus, while the filtering sleeve 46 may capture and retain the filtered debris in some embodiments, the filtering sleeve 46 is not required to capture and retaining all of the filtered debris in all embodiments or situations.

A bull nose 60 is optionally provided below the cleanout tool 40 and at the bottom of the tubing string 26 to guide the tubing string 26 for drillable tools. The bull nose 60 would typically be omitted where the downhole tool 30 is a service tool. A stabilizer 70 is also coupled to the tubing string 26 and may be a component of the well tool 40. The stabilizer 70 may centralize the tubing string 26 and/or specifically the well tool 40 within the wellbore. Centralizing the well tool 40 may prevent the well tool 30 and cleanout tool 40 from scraping on the low side, potentially damaging any slips/elements and the diverter.

The mandrel 42 may be a tubular mandrel having a through bore in fluid communication with the tubing string 26 so flow through the tubing string may pass through the well tool 40. A tubular mandrel is particularly useful on service tools because of the need for the well tool 40 to remain coupled to the work string while fluids are delivered. Such tubular mandrels must meet certain strength requirements, such as tension and torsion requirements, which may require a relatively large diameter mandrel as compared to the wellbore.

Alternatively, a solid mandrel (no through bore) may be used in some embodiments. A solid mandrel may be well suited to drillable well tools, for example, for which the mandrel does not have to meet the same tension/torsion requirements. The solid mandrel may accordingly be made slimmer as compared with a tubular mandrel. As a result, a greater-volume collection area is achieved between the mandrel of smaller outer diameter (OD) and the filtering sleeve about the mandrel. For example, a tubular mandrel with a 4.75 inch OD mandrel and a 3 inch ID may be used with a well tool for 9.6 inch (244 mm) to 10.8 inch (274 mm) casing. That may normally be equivalent to a solid mandrel with an OD of about 3.7 inches (94 mm). However, the drillable tool with solid mandrel would likely have no tools below so the tension rating would be less relevant and it may be possible to use a mandrel with an OD as small as 1.5 to 2 inches (38 to 51 mm). Thus, it may be possible to reduce the OD of a solid mandrel to less than half the OD of a tubular mandrel required for a service tool in a same borehole size, to achieve a significantly larger collection area inside of the filtering sleeve.

Figure 3:
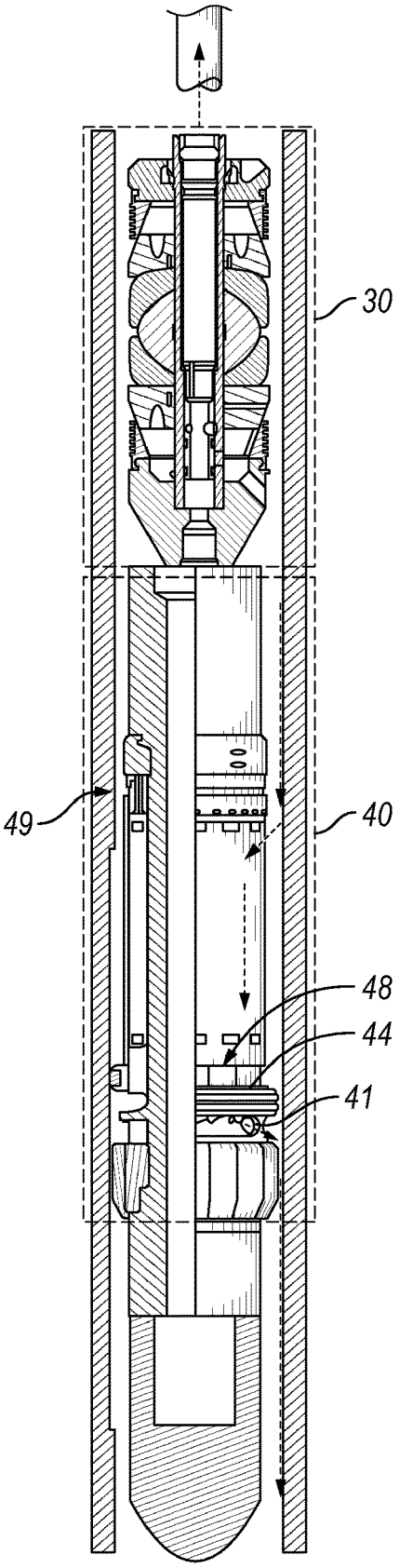
FIG. 3 is an enlarged view of the configuration of FIG. 2 with the cleanout tool in a bypass mode.

FIG. 3 is an enlarged view of the well tool 30 and cleanout tool 40 of FIG. 1, in a bypass mode. The diverter sleeve 44 has been shifted down relative to the tubing string, to the bypass position, such as by pulling up on the tubing string. This creates a gap 48 between the diverter sleeve 44 and the lower end of the filtering sleeve 46. Fluid may now flow by the cleanout tool 40 without filtering through the filtering sleeve 46 (a bypass feature 49 may facilitate this) without undue resistance that would otherwise result in a swabbing effect. As shown by flow arrows, fluid may now flow into the gap 48 and back out the ports 41 on the diverter sleeve 44.

Figure 4:
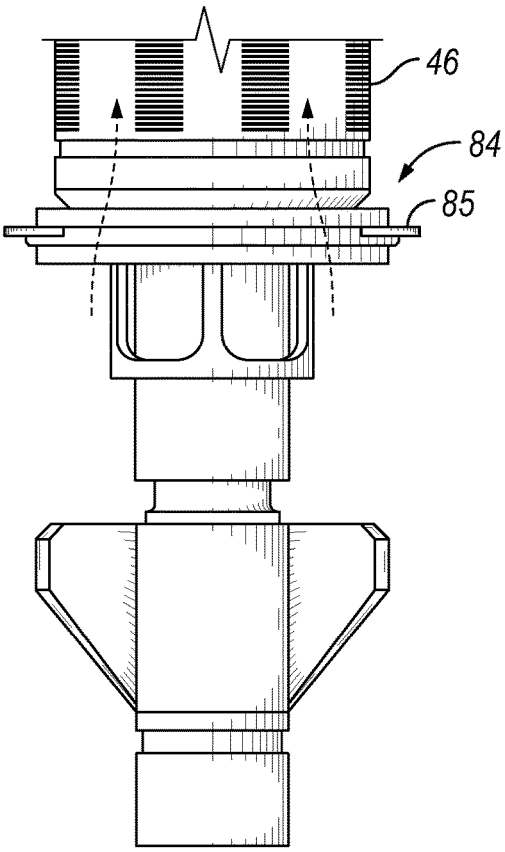
FIG. 4 is a side view of a flexible diverter in a filter mode.
Figure 5:
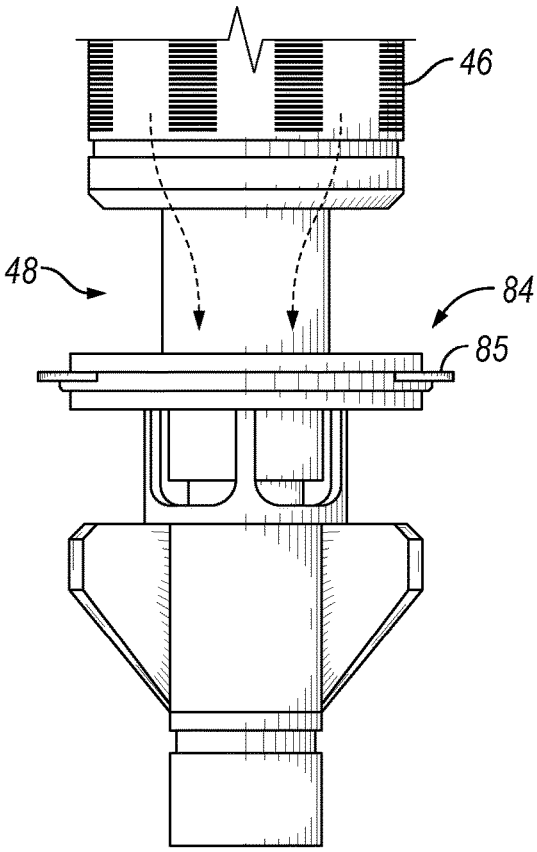
FIG. 5 is a side view of the flexible diverter in a bypass mode.

FIGS. 4 and 5 present an alternate example configuration of a diverter 84 having a flexible wiper 85. The diverter 84 is disposed below the filtering sleeve 46. FIG. 4 is a side view of the diverter 84 in a filter mode, with the diverter 84 against a lower end of the filtering sleeve 46. The flexible wiper 85 is flexible in that it is sufficiently compliant to flex in response to movement along the wellbore, and the flexibility also helps it conform to the shape of the wellbore. The flexible wiper 85 may be more compliant than other, more rigid types of wipers, which may allow for a greater range of or deviation in wellbore ID to be wiped/cleaned. The flexible wiper 85 may be less rigid than a scraper that is intended to more forcibly contact the wellbore to dislodge debris. However, even the flexible wiper 85 may help dislodge looser debris prior to that debris being filtered by the filter tool after being loosened by the wiper 85. Other suitable examples of wipers for a flexible diverter include a wire brush.

FIG. 5 is a side view of the diverter 84 having been moved to a bypass mode, such as by pulling the well tool upward. In the bypass mode, the diverter 84 has been shifted axially downward with respect to the filtering sleeve 46, to create the gap 48 for flow bypass as described above. Despite its relative flexibility, the flexible wiper 85 may frictionally contact the wellbore sufficiently to shift the diverter 84 away from the filter sleeve 46 in response to upward movement of the well tool.

Figure 6:
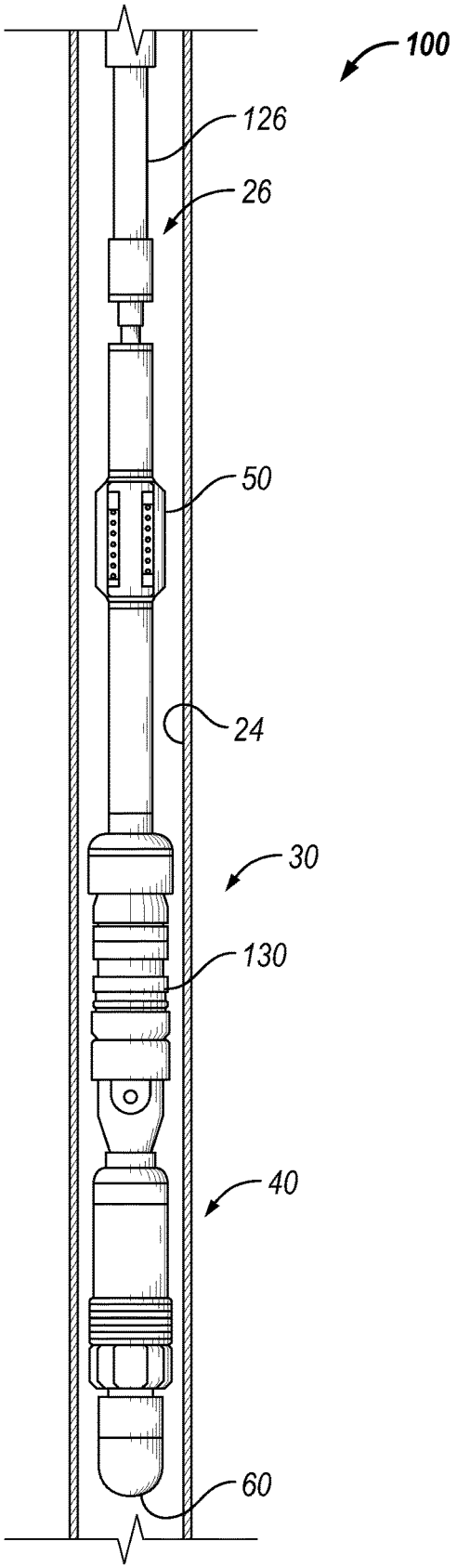
FIG. 6 is a side view of an example configuration of a tool deployment and cleanout system wherein the well tool comprises a drillable packer.

FIG. 6 is a side view of a tool deployment and cleanout system 100 incorporating the well tool 30 and cleanout tool 40 according to an example configuration. The tubing string 26 on which this system 100 is deployed comprises a drill pipe 126, which may extend from a surface of the wellsite. The well tool 30 comprises a drillable packer 130, which is intended to seal against the ID of the casing 24 and is therefore vulnerable to debris in a well. For example, debris may interfere with proper sealing of the packer 130 with the casing 24, causing a leak. The cleanout tool 40 is coupled to the drill pipe 126 below the well tool 30 to filter out such debris from reaching the packer 130. The optional bull nose 60 is also included to guide the drill string 26.

Figure 7A:
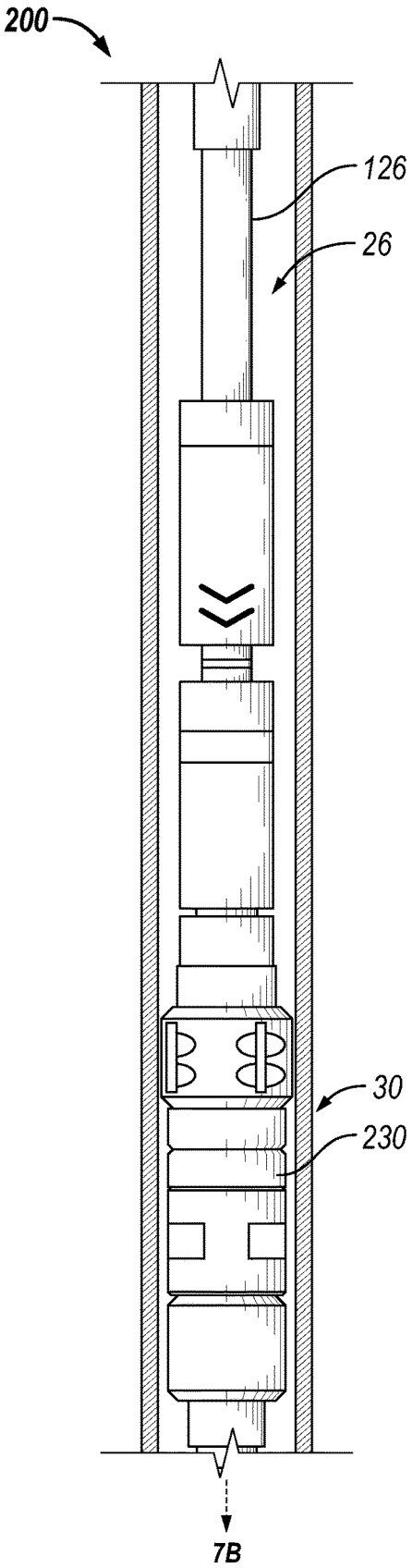
FIGS. 7A and 7B are a split side view of another example configuration of a tool deployment and cleanout system wherein the well tool comprises a storm packer.
Figure 7B:
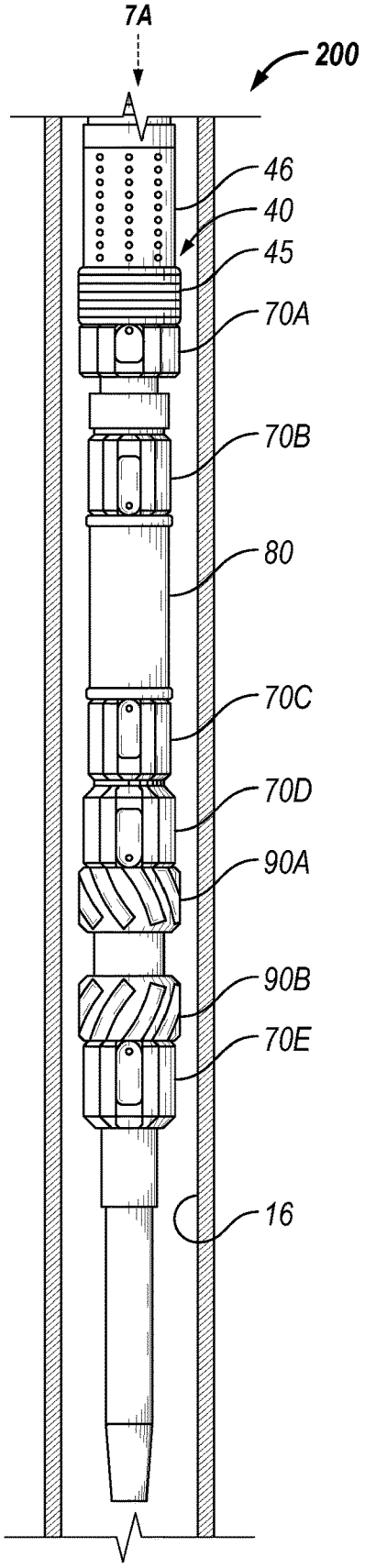

FIGS. 7A and 7B are side views of another example configuration of a tool deployment and cleanout system 200 incorporating the well tool 30 and cleanout tool 40 according to another example configuration. FIGS. 7A and 7B form a split view such that the bottom of FIG. 7A corresponds to the top of FIG. 7B. The tubing string 26 may again comprise drill pipe 126 or other tubular member that may be lowered from the surface of the wellsite. The well tool 30 comprises a storm packer 230, which is another example of a well tool to be protected from debris. The storm packer 130 is coupled from below to the drill pipe 126. The cleanout tool 40 is also coupled to the drill pipe 126 below the well tool 30.

Additional features are included on the tubing string 26 to facilitate various aspects of the tubing string and tool operation. In this example, five stabilizers 70A, 70B, 70C, 70D, 70E are spaced-apart along the tubing string 26 to help centralize the tubing string 26 within the wellbore 16 and ensure proper spacing and operation between the well tool 30 and cleanout tool 40 from the wellbore 16. Two scrapers 90A, 90B are also spaced apart along the tubing string 26 below the cleanout tool 40. The scrapers 90A, 90B may be rigid members that forcibly contact the wellbore 16 to dislodge debris ahead of the filtering sleeve 46 and the well tool 30. A magnet 80 is disposed between two of the stabilizers 70B, 70C to help capture any loose ferromagnetic debris ahead of the cleanout tool 40, which may reduce the amount of debris that has to be filtered by the filtering sleeve 46. As the system 200 is lowered in the wellbore, the scrapers 90A, 90B may forcibly dislodge debris ahead of the wiper 45. The wiper 45, trailing the scrapers 90A, 90B, may then help wipe the debris from the wellbore and help prevent the loosened debris from moving up past the wiper 45. At least some of the ferromagnetic debris may adhere to the magnet 80. The fluid and fluid-borne debris may flow into the filtering sleeve 46 so that the filtered debris is prevented from reaching the well tool 30, and specifically, from interfering with operation of the storm packer 230.

Figure 8:
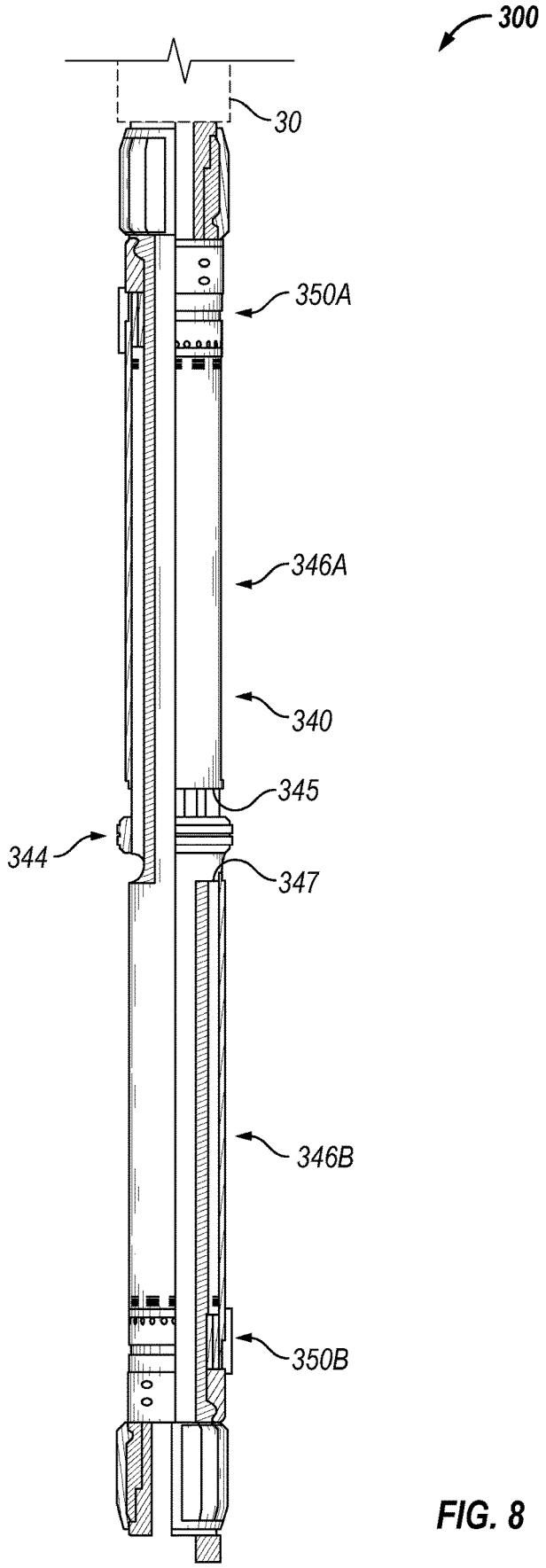
FIG. 8 is a side view of a tool deployment and cleanout system that filters both when running into hole and pulling out of hole.

FIG. 8 is a side view of a tool deployment and cleanout system 300 according to another example configuration wherein the cleanout tool 340 is configured to filter both when running into hole and pulling out of hole. The well tool 30 is coupled to the system 300 above a cleanout tool 340 having first and second filtering sleeves, namely, an upper filtering sleeve 346A and a lower filtering sleeve 346B. A diverter 344 disposed between the upper and lower filtering sleeves 346A, 346B is shiftable so that it is simultaneously in a filtering position with respect to one of the two filtering sleeves 346A, 346B and in a bypass position with respect to the other of the two filtering sleeves 346A, 346B, depending on whether the system 300 is being run into hole or pulled out of hole.

When running in hole, the diverter 344 is shifted into engagement with a lower end 345 of the upper filter sleeve 346A and away from an upper end 347 of the lower filter sleeve 346B. Thus, when run into hole, fluid and debris flow into the upper filter sleeve 346A (filter mode) and around the lower filter sleeve 346B (bypass mode). An uphole modulating bypass valve 350A is provided at the upper end of the filtering tool 340, which provides flow bypass during RIR in the event that the upper filter sleeve 346A becomes full.

When pulling out of hole, the diverter 344 is alternately shifted into engagement with the upper end 347 of the lower filter sleeve 346B and away from the lower end 345 of the upper filter sleeve 346A. Thus, fluid and debris flow into the lower filter sleeve 346B (filter mode) and around the upper filter sleeve 346A (bypass mode) when pulled out of hole. A downhole modulating bypass valve 350B is provided at the lower end of the filtering tool 340, which provides flow bypass in the event that the lower filter sleeve 346B becomes full while pulled out of hole.

The foregoing well tools, filtering tools, and systems incorporating them are provided by way of example and include but are not limited to the following statements.

Statement 1. A method, comprising: deploying a well tool on a tubular conveyance to a depth in a well; wiping an interior surface of the well ahead of the well tool as the tubular conveyance advances downhole; filtering debris ahead of the well tool when the tubular conveyance advances downhole to prevent the filtered debris from reaching the well tool; and using the well tool to perform a tool function when the well tool has reached the depth.

Statement 2. The method of Statement 1, further comprising: wiping the interior surface of the well using a wiper coupled to the tubular conveyance below the well tool; and performing the filtering using a filtering sleeve coupled to the tubular conveyance below the well tool.

Statement 3. The method of Statement 2, further comprising: using relative movement between the tubing string and the well to shift a diverter to a filtering position in sealing engagement with the filtering sleeve, whereby well fluid enters the filtering sleeve through ports on the diverter.

Statement 4. The method of Statement 3, further comprising: using relative movement between the tubing string and the well to alternately shift the diverter from the filtering position to a bypass position having a gap between the diverter and the filtering sleeve through which fluid flows without filtering through the filtering sleeve.

Statement 5. The method of any of Statements 1-4, further comprising: scraping the interior surface of the well at one or more different axial locations along the tubular conveyance ahead of the well tool.

Statement 6. The method of any of Statements 1-5, further comprising: magnetically capturing a ferromagnetic portion of the debris ahead of the well tool.

Statement 7. The method of any of Statements 1-6, further comprising: securing the well tool to the interior of the well and retrieving the tubular conveyance from the well before performing the tool function.

Statement 8. The method of Statement 7, further comprising: retrieving or drilling out the well tool in a separate, subsequent trip from deploying the well tool.

Statement 9. The method of any of Statements 1-8, further comprising: leaving the well tool on the tubular conveyance while performing a well service comprising flowing a fluid through the tubular conveyance and the well tool; and subsequently retrieving the well tool on the tubular conveyance.

Statement 10. The method of any of Statements 1-9, further comprising: using a first filtering sleeve for the step of filtering debris ahead of the well tool when the tubular conveyance advances downhole; and using a second filtering sleeve for filtering debris when the tubular conveyance advances uphole.

Statement 11. A tool deployment and cleanout system, comprising: a well tool comprising a mandrel coupled to a tubular conveyance for deploying the well tool into a well; a wiper coupled to the tubular conveyance below the well tool, the wiper positioned for slidingly contacting an interior of a wellbore; and a filtering sleeve coupled to the tubular conveyance below the well tool, the filtering sleeve positioned to filter debris ahead of the well tool to keep the debris from reaching the well tool.

Statement 12. The tool deployment and cleanout system of Statement 11, wherein the filtering sleeve is disposed about the mandrel to define an annular collection chamber between the mandrel and filtering sleeve.

Statement 13. The tool deployment and cleanout system of Statement 11 or 12, further comprising: a valve element axially shiftable between a filtering position directing wellbore fluid into the filtering sleeve and a bypass position directing the wellbore fluid around the filtering sleeve.

Statement 14. The tool deployment and cleanout system of Statement 13, wherein the valve element automatically shifts to the filtering position in response to advancing the tubular conveyance downhole and to the bypass position when the tubular conveyance stops advancing or advances uphole.

Statement 15. The tool deployment and cleanout system of Statement 13 or 14, further comprising: another filtering sleeve coupled to the tubular conveyance below the well tool, wherein the valve element automatically shifts to a filtering position with respect to the another filtering sleeve for directing wellbore fluid into the another filtering sleeve when the tubular conveyance advances uphole.

Statement 16. The tool deployment and cleanout system of Statement 15, wherein the valve element comprises a diverter disposed between the filtering sleeve and another filtering sleeve, such that the diverter is simultaneously in the filtering position with respect to one of the two filtering sleeves and in the bypass position with respect to the other of the two filtering sleeves.

Statement 17. The tool deployment and cleanout system of Statement 16, further comprising a modulating bypass valve fluidically coupled to at least one of the filtering sleeves allowing flow bypass when at least one of the filtering sleeves is full of the debris.

Statement 18. The tool deployment and cleanout system of any of Statements 13-17, wherein the wiper is integrated into the valve element such that sliding contact between the wiper and the interior of the wellbore when advancing the tubular conveyance downhole axially shifts the valve element to the filter position.

Statement 19. A tool deployment and cleanout system, comprising: a well tool comprising a mandrel coupled to a tubular conveyance for deploying the well tool into a well; an upper filtering sleeve coupled to the tubular conveyance below the well tool, the upper filtering sleeve positioned to filter debris ahead of the well tool when running into hole; and a lower filtering sleeve coupled to the tubular conveyance and positioned to filter debris when pulling out of hole.

Statement 20. The tool deployment and cleanout system of Statement 19, further comprising: a diverter positioned between the upper and lower filtering sleeves; wherein the diverter is axially shiftable to a filtering position with the respect to the upper filtering sleeve and a bypass position with respect to the lower filtering sleeve in response to running into hole; and wherein the diverter is axially shiftable to a bypass position with respect to the upper filtering sleeve and a filtering position with respect to the lower filtering sleeve when pulling out of hole; and wherein flow is directed into the respective filtering sleeve when in the filtering position and around the respective filtering sleeve when in the bypass position.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A method, comprising:

deploying a well tool on a tubular conveyance to a depth in a well;

wiping an interior surface of the well ahead of the well tool as the tubular conveyance advances downhole;

filtering debris ahead of the well tool using a filtering sleeve when the tubular conveyance advances downhole to prevent the filtered debris from reaching the well tool; and using the well tool to perform a tool function when the well tool has reached the depth.

2. The method of claim 1, wherein the wiping is performed using a wiper coupled to the tubular conveyance below the well tool, and wherein the filtering is performed using a filtering sleeve coupled to the tubular conveyance below the well tool.

3. The method of claim 2, further comprising:

using relative movement between the tubular conveyance and the well to shift a diverter to a filtering position in sealing engagement with the filtering sleeve, whereby well fluid enters the filtering sleeve through ports on the diverter.

4. The method of claim 3, further comprising:

using relative movement between the tubular conveyance and the well to alternately shift the diverter from the filtering position to a bypass position having a gap between the diverter and the filtering sleeve through which fluid flows without filtering through the filtering sleeve.

5. The method of claim 1, further comprising:

scraping the interior surface of the well at one or more different axial locations along the tubular conveyance ahead of the well tool.

6. The method of claim 1, further comprising:

magnetically capturing a ferromagnetic portion of the debris ahead of the well tool.

7. The method of claim 1, further comprising:

securing the well tool to the interior of the well and retrieving the tubular conveyance from the well before performing the tool function.

8. The method of claim 7, further comprising:

retrieving or drilling out the well tool in a separate, subsequent trip from deploying the well tool.

9. The method of claim 1, further comprising:

leaving the well tool on the tubular conveyance while performing a well service comprising flowing a fluid through the tubular conveyance and the well tool; and subsequently retrieving the well tool on the tubular conveyance.

10. The method of claim 1, further comprising:

using a first filtering sleeve for the step of filtering debris ahead of the well tool when the tubular conveyance advances downhole; and using a second filtering sleeve for filtering debris when the tubular conveyance advances uphole.

11. A tool deployment and cleanout system, comprising:

a well tool comprising a mandrel coupled to a tubular conveyance for deploying the well tool into a well;

a wiper coupled to the tubular conveyance below the well tool, the wiper positioned for slidingly contacting an interior of a wellbore; and a filtering sleeve coupled to the tubular conveyance below the well tool, the filtering sleeve positioned to filter debris ahead of the well tool when the tubular conveyance advances downhole to keep the debris from reaching the well tool.

12. The tool deployment and cleanout system of claim 11, wherein the filtering sleeve is disposed about the mandrel to define an annular collection chamber between the mandrel and filtering sleeve.

13. The tool deployment and cleanout system of claim 11, further comprising:

a valve element axially shiftable between a filtering position directing wellbore fluid into the filtering sleeve and a bypass position directing the wellbore fluid around the filtering sleeve.

14. The tool deployment and cleanout system of claim 13, wherein the valve element automatically shifts to the filtering position in response to advancing the tubular conveyance downhole and to the bypass position when the tubular conveyance stops advancing or advances uphole.

15. The tool deployment and cleanout system of claim 13, further comprising:

another filtering sleeve coupled to the tubular conveyance below the well tool, wherein the valve element automatically shifts to a filtering position with respect to the another filtering sleeve for directing well fluid into the another filtering sleeve when the tubular conveyance advances uphole.

16. The tool deployment and cleanout system of claim 15, wherein the valve element comprises a diverter disposed between the filtering sleeve and another filtering sleeve, such that the diverter is simultaneously in the filtering position with respect to one of the two filtering sleeves and in the bypass position with respect to the other of the two filtering sleeves.

17. The tool deployment and cleanout system of claim 16, further comprising a modulating bypass valve fluidically coupled to at least one of the filtering sleeves allowing flow bypass when at least one of the filtering sleeves is full of the debris.

18. The tool deployment and cleanout system of claim 13, wherein the wiper is integrated into the valve element such that sliding contact between the wiper and the interior of the wellbore when advancing the tubular conveyance downhole axially shifts the valve element to the filter position.

19. A tool deployment and cleanout system, comprising:

a well tool comprising a mandrel coupled to a tubular conveyance for deploying the well tool into a well;

an upper filtering sleeve coupled to the tubular conveyance below the well tool, the upper filtering sleeve positioned to filter debris ahead of the well tool when running into hole but not when pulling out of hole; and a lower filtering sleeve coupled to the tubular conveyance and positioned to filter debris when pulling out of hole but not when running into hole.

20. The tool deployment and cleanout system of claim 19, further comprising:

a diverter positioned between the upper and lower filtering sleeves;

wherein the diverter is axially shiftable to a filtering position with the respect to the upper filtering sleeve and a bypass position with respect to the lower filtering sleeve in response to running into hole; and wherein the diverter is axially shiftable to a bypass position with respect to the upper filtering sleeve and a filtering position with respect to the lower filtering sleeve when pulling out of hole; and wherein flow is directed into the respective filtering sleeve when in the filtering position and around the respective filtering sleeve when in the bypass position.

* * * * *